US009905899B2

(12) United States Patent
Ju

(10) Patent No.: US 9,905,899 B2
(45) Date of Patent: Feb. 27, 2018

(54) HIGH-FREQUENCY HIGH-POWER TERMINATOR

(71) Applicant: Electronics and Telecommunications Research Institute, Daejeon (KR)

(72) Inventor: In Kwon Ju, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 64 days.

(21) Appl. No.: 14/993,493

(22) Filed: Jan. 12, 2016

(65) Prior Publication Data

US 2017/0054192 A1 Feb. 23, 2017

(30) Foreign Application Priority Data

Aug. 17, 2015 (KR) ..... 10-2015-0115390

(51) Int. Cl.
*H01P 1/26* (2006.01)

(52) U.S. Cl.
CPC ..... *H01P 1/268* (2013.01)

(58) Field of Classification Search
CPC ..... H01P 1/268; H01P 1/24; H01P 1/26
USPC ..... 333/22 R
See application file for complete search history.

(56) References Cited

U.S. PATENT DOCUMENTS

| | | | | |
|---|---|---|---|---|
| 3,678,417 | A * | 7/1972 | Ragan | H01P 1/268 333/22 R |
| 4,647,877 | A | 3/1987 | Thompson | |
| 5,945,905 | A | 8/1999 | Mazzochette | |
| 6,054,909 | A | 4/2000 | Lee et al. | |
| 7,042,305 | B2 | 5/2006 | Wray | |
| 2001/0000428 | A1 * | 4/2001 | Abadeer | H04L 25/0278 333/33 |
| 2004/0227582 | A1 | 11/2004 | Jain | |
| 2008/0297283 | A1 | 12/2008 | Byun et al. | |
| 2014/0292441 | A1 | 10/2014 | Takei | |

OTHER PUBLICATIONS

Benito López-Berrocal et al., "Design and Implementation of DC-20-GHz Lumped Resistor Matched Loads for Planar Microwave Circuits," IEEE Transactions on Microwave Theory and Techniques, Oct. 2009, pp. 2439-2443, vol. 57, No. 10, IEEE.
Nitin Jain et al., "Design of a DC-to-90-GHz Resistive Load," IEEE Microwave and Guided Wave Letters, Feb. 1999, pp. 69-70, vol. 9, No. 2, IEEE.
H. C. Jiang et al., "Microwave power thin film resistors for high frequency and high power load applications," Applied Physics Letters, Oct. 2010, pp. 1-3, 97, 173504, AIP Publishing.

* cited by examiner

*Primary Examiner* — Stephen E Jones
(74) *Attorney, Agent, or Firm* — William Park & Associates Ltd.

(57) ABSTRACT

A high-frequency high-power terminator is disclosed. Specifically, the high-frequency high-power terminator has a new structure which uses a resistive element in a distributed element form to achieve broadband matching and to have improved rated power.

7 Claims, 12 Drawing Sheets

HIGH-FREQUENCY HIGH-POWER TERMINATOR

CROSS-REFERENCE TO RELATED APPLICATION

This application claims the priority benefit of Korean Patent Application No. 10-2015-0115390, filed on Aug. 17, 2015, in the Korean Intellectual Property Office, the disclosure of which is incorporated herein by reference.

BACKGROUND

1. Field of the Invention

Embodiments relate to a high-frequency high-power terminator, and more particularly, to a terminator having high rated power which operates in a high-frequency range, that is, a radio frequency (RF)/microwave/millimeter-wave range.

2. Description of the Related Art

A high-frequency terminator is used for transceivers of various wireless systems for personal mobile communications and satellite communications to eliminate radio frequency (RF)/microwave/millimeter-wave signals. Recently, there is a trend towards increasing standards of available frequency bands and output power for various wireless systems including fifth generation (5G) wireless communications. Here, RF/microwave/millimeter-wave components using a high-frequency terminator include an isolator, a 90 degree hybrid coupler, a coupled-line directional coupler, ring-hybrid and Lange couplers, magic T, and the like.

As higher power is applied to the RF/microwave/millimeter-wave components, higher rated power is needed for the high-frequency terminator. Here, electromagnetic-wave energy applied to the high-frequency terminator is converted into heat energy, and the heat energy is cooled through a heat sink. Here, when the high-frequency terminator has low rated power, the high-frequency terminator does not withstand the applied power and is burned up.

Thus, the high-frequency terminator is required to maintain input matching in a wide operating frequency range. Further, the high-frequency terminator needs to have high rated power to withstand high input power and not to be destroyed, which is described in detail with reference to FIGS. 1A to 1D. FIGS. 1A to 1D illustrate various forms of conventional high-frequency terminators.

Referring to FIG. 1A, a high-frequency terminator includes an input terminal P1, a transmission line 10, a thin film resistor 11, and a via hole for a ground 12. The ground is realized as a bonding wire or short transmission line in addition to the via hole 12.

FIG. 1B illustrates a schematic circuit diagram of the high-frequency terminator of FIG. 1A. As illustrated in FIG. 1B, the high-frequency terminator is a lumped element including a resistor and a ground. Here, the resistor is generally a film resistor, which includes a thin film resistor and a thick film resistor. Since a thin film resistor has small parasitic inductive and capacitive elements and a small resistance tolerance as compared with a thick film resistor, a thin film resistor is generally used for a high-frequency terminator.

Referring to FIG. 1C, the high-frequency terminator includes an equivalent circuit considering parasitic elements of the high-frequency terminator based on FIG. 1B. Here, the resistor has parasitic capacitance $C_R$ and parasitic inductance $L_R$. The ground has parasitic resistance $R_G$, parasitic capacitance $C_G$ and parasitic inductance $L_G$. Equation 1 represents characteristic impedance of the conventional high-frequency terminator based on the equivalent circuit of FIG. 1C.

[Equation 1]

$$Z = \left\{ \frac{R}{(1-\omega^2 L_R C_R)^2 + (\omega C_R R)^2} + \frac{R_G}{(1-\omega^2 L_G C_G)^2 + (\omega C_G R_G)^2} \right\} + j\left\{ \frac{\omega L_R\left(1-\omega^2 L_R C_R - \frac{C_R R^2}{L_R}\right)}{(1-\omega^2 L_R C_R)^2 + (\omega C_R R)^2} + \frac{\omega L_G\left(1-\omega^2 L_G C_G - \frac{C_G R_G^2}{L_G}\right)}{(1-\omega^2 L_G C_G)^2 + (\omega C_G R_G)^2} \right\} \quad (1)$$

Here, ω is 2π frequency. As indicated by Equation 1, in the impedance of the high-frequency terminator, not only an imaginary part but also a real part changes on a frequency by effects of the parasitic elements.

FIG. 1D illustrates a graph illustrating an example of return loss and characteristic impedance of the conventional high-frequency terminator. Here, the conventional high-frequency terminator is a diamond chip resistor in 0402 size, 50 ohm, manufactured by EMC technology (www.emc-rflabs.com) and has an operating range up to 30 GHz. Here, impedance of an ideal high-frequency terminator needs to have systemic characteristic impedance regardless of a frequency, that is, generally a real part of 50 Ohm and an imaginary part of 0 Ohm. However, as illustrated in FIG. 1D, at a frequency of 5 GHz or greater, the real part and imaginary part of the impedance of the conventional high-frequency terminator start increasing by the effects of the parasitic elements and the return loss becomes worse to 20 dB or less. Such a phenomenon is due to an increase in the effects of the parasitic elements increase with a higher frequency as indicated by Equation 1.

In the end, as a higher frequency is used, the conventional high-frequency terminator is affected by the parasitic elements to deteriorate in reflection coefficient characteristic. Here, the high-frequency terminator employs an open radial stub to improve deterioration in high-frequency characteristics caused by the parasitic elements of the ground via hole, thereby improving the reflection coefficient characteristic based on a particular frequency. However, since the open radial stub operates as grounded capacitance at a high frequency to have a certain bandwidth, the high-frequency terminator has a narrow bandwidth.

[Equation 2]

$$P \propto \frac{KA}{h}$$

Equation 2 represents rated power of the high-frequency terminator. Here, P represents power (watt), and K represents thermal conductivity (Watt/mK) of a substrate on which the film resistor is deposited. Further, A represents area of the film resistor, and h represents thickness of the substrate.

As indicated by Equation 2, the high-frequency terminator needs to use a thin substrate with high thermal conductivity in order to increase power consumed in the terminator, that is, rated power. To this end, the high-frequency terminator employs beryllium oxide, aluminum nitride or CVD diamond substrates which are relatively expensive but have high thermal conductivity, instead of an alumina substrate.

Also, in order to increase the rated power of the high-frequency terminator, the high-frequency terminator needs to have a large area of the thin film resistor. On the contrary, when the lumped element, such as the thin film resistor, has a one-tenth or smaller size of wavelength of a used frequency, the high-frequency terminator has less effect of the parasitic elements and exhibits original properties. That is, as a higher frequency has a shorter wavelength, the lumped element needs to be small in proportion to wavelength. Therefore, when the size of the thin film resistor is reduced with a higher frequency being used, the rated power of the high-frequency terminator decreases, and there are limitations in increasing the rated power by increasing the area of the thin film resistor.

Thus, since the high-frequency terminator has inferior reflection coefficient characteristic, a narrowband and low rated power, there is a need for a high-frequency high-power terminator with a new structure which achieves broadband matching in RF/microwaves/millimeter waves and has improved rated power.

SUMMARY

An aspect provides a high-frequency high-power terminator with a new structure which achieves broadband matching in radio frequency (RF)/microwaves/millimeter waves and has improved rated power by addressing problems of worsening matching and reducing rated power with a frequency increase.

According to an aspect, there is provided a high-frequency high-power terminator including: a signal input terminal to which an RF signal is input; a transmission line through which the RF signal input from the signal input terminal is transferred; and a thin film resistor in a distributed element form configured to be in contact with one side of the transmission line so that the RF signal is input.

The transmission line may exhibit impedance specified in advance.

The high-frequency high-power terminator may further include an impedance matching circuit interposed between the signal input terminal and the transmission line.

The impedance matching circuit may be interposed to match the RF signal input from the signal input terminal with impedance of the transmission line.

The transmission line may include a first side to which the RF signal is input and a second side in contact with the thin film resistor, and the second side may have a wider width than the first side.

The first side may be connected to at least one of the signal input terminal and the impedance matching circuit interposed between the signal input terminal and the transmission line.

The thin film resistor may be a resistive element including one side in contact with the transmission line.

The thin film resistor may be a resistive element in a semicircular form including one side in contact with the transmission line.

The thin film resistor may be a resistive element in a polygonal form including one side in contact with the transmission line.

The thin film resistor may be a resistive element in a radial stub form including one side in contact with the transmission line.

According to another aspect, there is provided a high-frequency high-power terminator including: a signal input terminal to which an RF signal is input; a transmission line through which the RF signal input from the signal input terminal is transferred; a thin film resistor in a distributed element form configured to be in contact with one side of the transmission line so that the RF signal is input; and a via hole pad configured to be in contact with one side of the thin film resistor and to comprise a plurality of via holes connected to a ground.

The transmission line may exhibit impedance specified in advance.

The high-frequency high-power terminator may further include an impedance matching circuit interposed between the signal input terminal and the transmission line.

The impedance matching circuit may be interposed to match the RF signal input from the signal input terminal with impedance of the transmission line.

The transmission line may include a first side to which the RF signal is input and a second side in contact with the thin film resistor, and the second side may have a wider width than the first side.

The first side may be connected to at least one of the signal input terminal and the impedance matching circuit interposed between the signal input terminal and the transmission line.

The thin film resistor may be a resistive element including one side in contact with the transmission line.

The thin film resistor may be a resistive element in a semicircular form including one side in contact with the transmission line.

The thin film resistor may be a resistive element in a polygonal form including one side in contact with the transmission line.

The thin film resistor may be a resistive element in a radial stub form including one side in contact with the transmission line.

BRIEF DESCRIPTION OF THE DRAWINGS

These and/or other aspects, features, and advantages of the invention will become apparent and more readily appreciated from the following description of embodiments, taken in conjunction with the accompanying drawings of which.

DETAILED DESCRIPTION

Hereinafter, embodiments of the present invention will be described in detail with reference to the accompanying drawings.

Figure 1A:
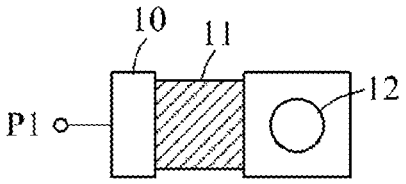
FIG. 1A PRIOR ART
FIG. 1A illustrates a conventional high-frequency terminator.
Figure 1B:
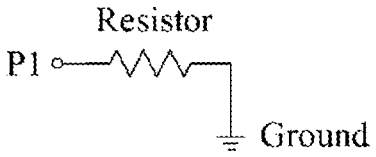
FIG. 1B PRIOR ART
FIG. 1B is a schematic circuit diagram illustrating the conventional high-frequency terminator.
Figure 1C:
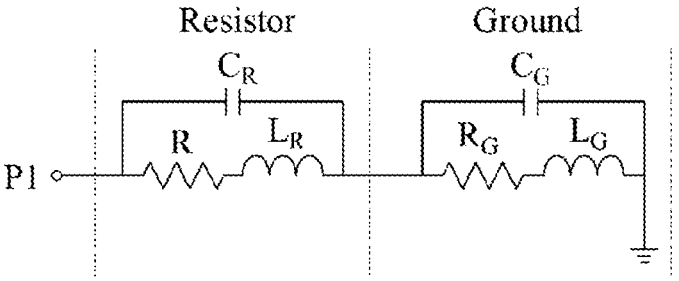
FIG. 1C PRIOR ART
FIG. 1C is an equivalent circuit diagram in view of a parasitic element of the conventional high frequency terminator.
Figure 1D:
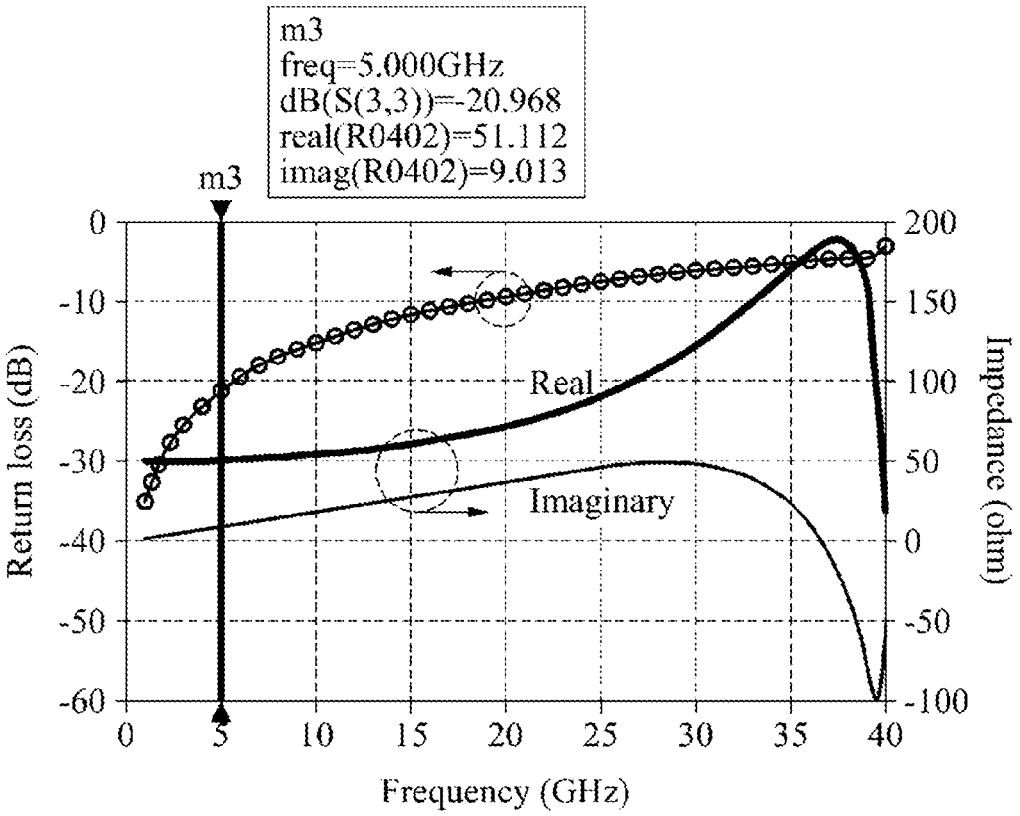
FIG. 1D PRIOR ART
FIG. 1D is a graph illustrating return loss and impedance of the conventional high-frequency terminator.
Figure 2:
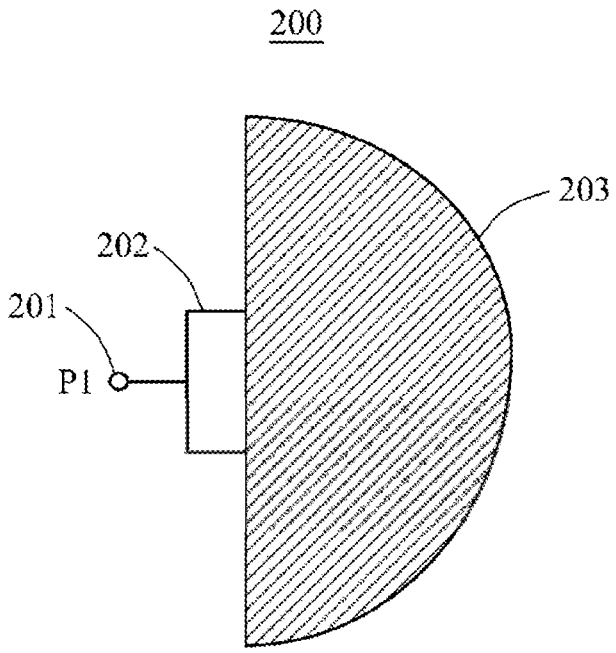
FIG. 2 illustrates a high-frequency high-power terminator according to an embodiment.

FIG. 2 illustrates a high-frequency high-power terminator according to an embodiment.

Referring to FIG. 2, a high-frequency high-power terminator 200 may include a signal input terminal 201, a transmission line 202, and a thin film resistor 203. Here, the high-frequency high-power terminator 200 may use a resistive element in a form of a distributed element to achieve broadband matching in a wide frequency range. Further, the high-frequency high-power terminator 200 may have high rated power due to a large area of the thin film resistor.

Specifically, a radio frequency (RF) signal may be input to the signal input terminal 201. For example, the RF signal is a high frequency signal, which may refer to a signal input to a transceiver, such as an antenna of a wireless communication device.

The transmission line 202 may refer to an electric conductor through which the RF signal input from the signal input terminal 201 is transferred. For example, the transmission line 202 may be an electric conductor through which the RF signal is transferred by propagation of waves by electrical parameters distributed in the electric conductor and between the signal input terminal 201 and the transmission line 202.

The transmission line 202 may exhibit impedance specified in advance. The transmission line 202 may include a first side to which the RF signal is input and a second side in contact with the thin film resistor, and the second side may have a wider width than the first side. Here, the transmission line 202 may be formed to have width or length adjusted depending on situations, thereby having an impact on characteristics and performance of a circuit based on an adjusted form.

That is, the transmission line 202 may exhibit impedance based on a ratio between a magnetic field and an electric field generated by an electric current flowing in the transmission line 202. The transmission line 202 may match the RF signal input from the signal input terminal 202 with the impedance specified in advance.

The thin film resistor 203 may be configured as a resistive element in a distributed element form and be in contact with one side of the transmission line so that the RF signal may be input. Here, the thin film resistor 203 may be configured as a resistive element in a distributed element form and thus have not only characteristics of a thin film resistor but also characteristics of an open radial stub. Accordingly, the thin film resistor 203 may obtain characteristics based on both a broad bandwidth and high rated power.

Here, the thin film resistor 203 may also be a semicircular resistive element having one side in contact with the transmission line, and various shapes of resistive elements may be used as shown in FIGS. 7 to 10, without being limited thereto.

Figure 3:
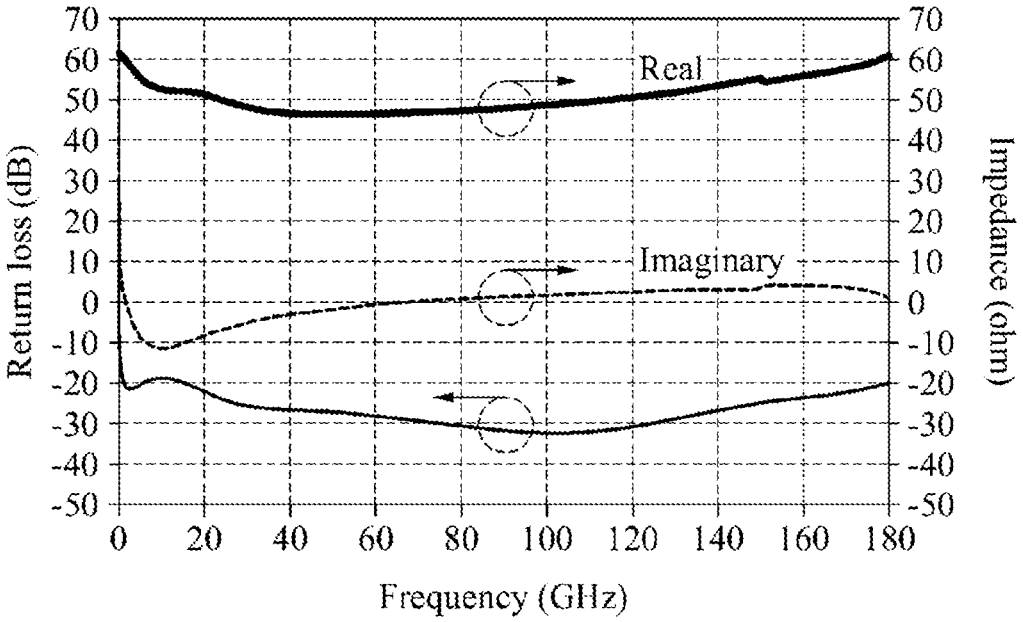
FIG. 3 is a graph illustrating return loss and frequency characteristics of impedance of the high-frequency high-power terminator according to the embodiment.

FIG. 3 is a graph illustrating return loss characteristics and frequency characteristics of impedance of the high-frequency high-power terminator according to the embodiment.

Referring to FIG. 3, the high-frequency high-power terminator 200 has a matched return loss of 20 dB or less in a wide band from about 1 to 180 GHz, thus exhibiting excellent reflection coefficient characteristics. More specifically, the high-frequency high-power terminator 200 employs the thin film resistor 203 in a distributed element form, so that a real part and an imaginary part of impedance may not substantially change even with an increase in frequency. That is, the real part of the impedance may be in a range of about 45 to 60 Ohm, and the imaginary part of the impedance may be in a range of −10 to +5 Ohm. Such characteristics may be exhibited in a similar pattern as characteristics of an ideal high-frequency terminator.

Here, a specified range may be a wide band from about 1 to 180 GHz, and the high-frequency high-power terminator 200 is matched to 20 dB or less in the wide band from about 1 to 180 GHz, thus exhibiting excellent reflection coefficient characteristics and a wide operating frequency range as compared with a conventional high-frequency terminator. Here, as a thinner substrate is used to design the high-frequency high-power terminator 200, a generated frequency in a parallel plate mode which limits a bandwidth may increase. Thus, the high-frequency high-power terminator 200 may increase a bandwidth thereof corresponding to an increase of the generated frequency in the parallel plate mode and thus is not limited to the bandwidth illustrated herein.

Figure 4:
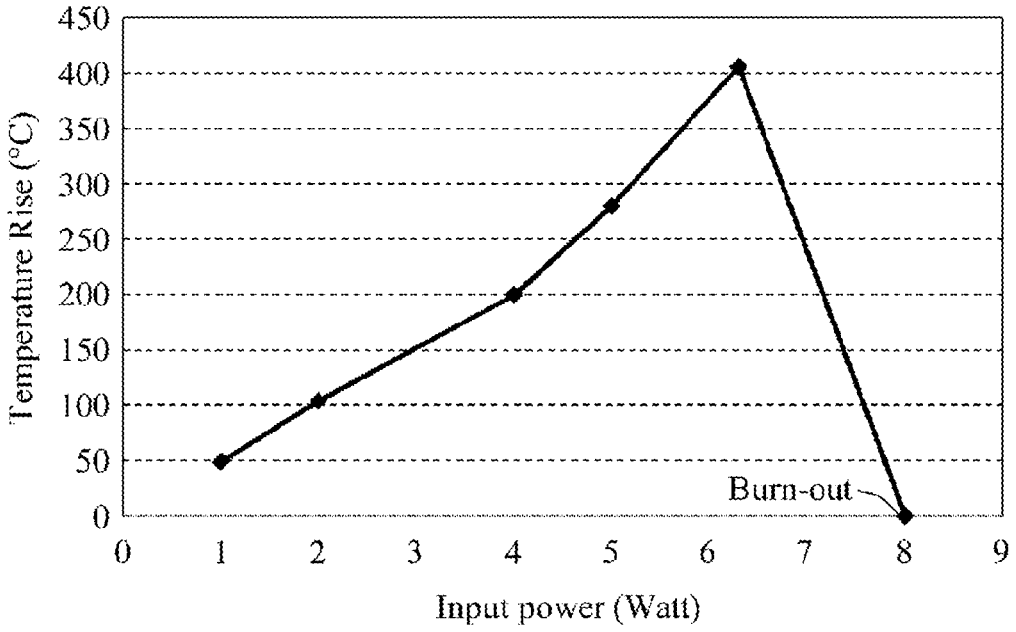
FIG. 4 is a graph temperature rise characteristics according to input power of the high-frequency high-power terminator according to the embodiment.

FIG. 4 is a graph temperature rise characteristics according to input power of the high-frequency high-power terminator according to the embodiment.

Referring to FIG. 4, the graph shows a result of measuring a rise in temperature of the thin film resistor 203 by applying RF power to the high-frequency high-power terminator 200, manufactured with an alumina substrate, fixed on a base plate heated to 70° C. Here, the applied RF power may be converted into heat energy in the thin film resistor 203 and be consumed.

As illustrated in FIG. 4, the temperature of the high-frequency high-power terminator 200 rises with an increase in input power and reaches about 400° C. at an input power of 6.3 Watt. At an input power of 8 Watt, the thin film resistor 203 is partially destroyed due to an excessive temperature rise. Thus, the high-frequency high-power terminator 200 manufactured with the alumina substrate has a rated power of about 6 Watt.

Furthermore, the high-frequency high-power terminator 200 needs to have a higher rated power level than an input RF power level corresponding to an RF power level. When rated power is small, the high-frequency high-power terminator does not withstand input power and is destroyed. Thus, the high-frequency high-power terminator 200 includes the thin film resistor 203 in a distributed element form having characteristics of an open radial stub as a resistive element and accordingly exhibits high rated power as illustrated in FIG. 4. Here, the measured rated power may be rated power of the high-frequency high-power terminator 200 manufactured using an alumina substrate. When a substrate having a higher thermal conductivity than the alumina substrate is used, the high-frequency high-power terminator 200 may obtain even higher rated power. That is, when a diamond substrate is used in view of thermal conductivity of the diamond substrate, the high-frequency high-power terminator 200 may obtain a rated power of hundreds of watts.

Figure 5:
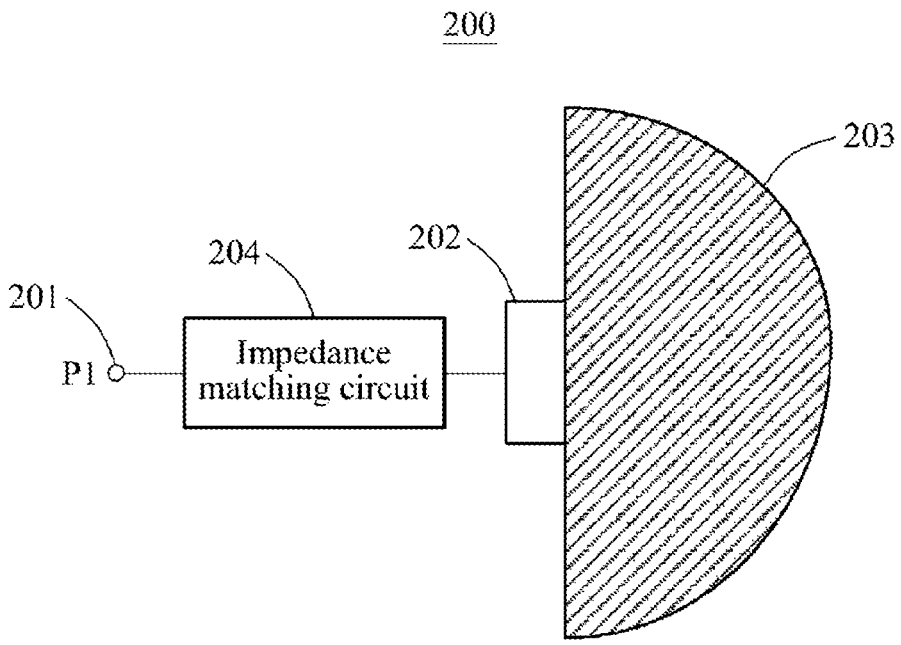
FIG. 5 illustrates a high-frequency high-power terminator according to another embodiment.

FIG. 5 illustrates a high-frequency high-power terminator according to another embodiment.

Referring to FIG. 5, a high-frequency high-power terminator 200 may include a signal input terminal 201, a transmission line 202, and a thin film resistor 203. Here, the high-frequency high-power terminator 200 may further include an impedance matching circuit 204 to improve reflection coefficient characteristics based on broadband matching. Here, the impedance matching circuit 204 may be interposed between the signal input terminal 201 and the transmission line 202.

In detail, the high-frequency high-power terminator 200 needs to match an RF signal with impedance of the transmission line. Here, when impedance matching is not properly achieved, the high-frequency high-power terminator 200 may have reflection of input power by mismatching.

Thus, the high-frequency high-power terminator 200 may match the RF signal input from the signal input terminal with the impedance of the transmission line using the impedance matching circuit 204 in order to minimize reflection of a signal generated on a contact point of the circuit.

For example, the high-frequency high-power terminator 200 may further include the impedance matching circuit 204 to equalize the impedance of the transmission line 202 to impedance of the thin film resistor 203 with respect to the input RF signal and to minimize reflection of the input signal.

Figure 6:
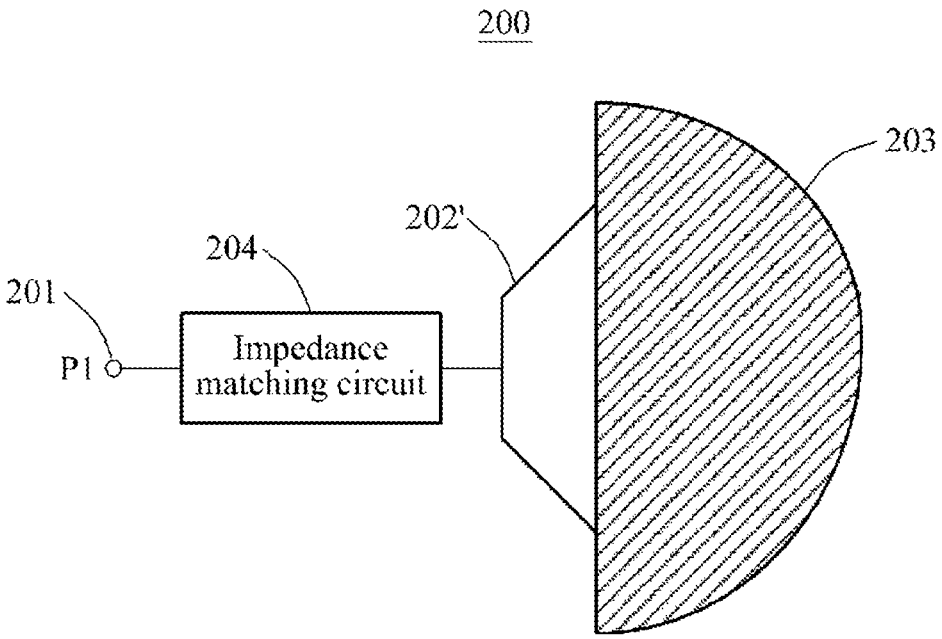
FIG. 6 illustrates a high-frequency high-power terminator according to further another embodiment.

FIG. 6 illustrates a high-frequency high-power terminator according to further another embodiment.

Referring to FIG. 6, a high-frequency high-power terminator 200 may include a signal input terminal 201, an impedance matching circuit 204, a transmission line 202, and a thin film resistor 203. Here, the transmission line 202 may be configured in a different form from the transmission line 202 illustrated in FIG. 4. Specifically, the transmission line 202 may include a first side to which an RF signal is input and a second side in contact with the thin film resistor. The second side may have a wider width than the first side.

The high-frequency high-power terminator 200 may convert electric energy with respect to the RF signal input from the signal input terminal 201 into heat energy as the RF signal is input to the thin film resistor 203. Here, when an electric current is concentrated in an input terminal of the thin film resistor 203 in a distributed element form, heat energy is also concentrated along with the electric current in the input terminal in the high-frequency high-power terminator 200, so that the thin film resistor 203 may be destroyed by heat.

Thus, the high-frequency high-power terminator 200 needs to distribute the RF signal input through the transmission line 202' in order to prevent destruction of the thin film resistor 203. To this end, the high-frequency high-power terminator 200 includes the transmission line 202' having the first side and the second side which are in different forms and allows the second side having an extended side to come into contact with the thin film resistor 203, thereby preventing destruction of the thin film resistor 203 by heat energy.

Here, the first side may be connected to at least one of the signal input terminal and the impedance matching circuit interposed between the signal input terminal and the transmission line. The high-frequency high-power terminator 200 may perform impedance matching between impedance of the transmission line 202' and impedance of the thin film resistor 203 with respect to the input RF signal using the impedance matching circuit 204.

Figure 7:
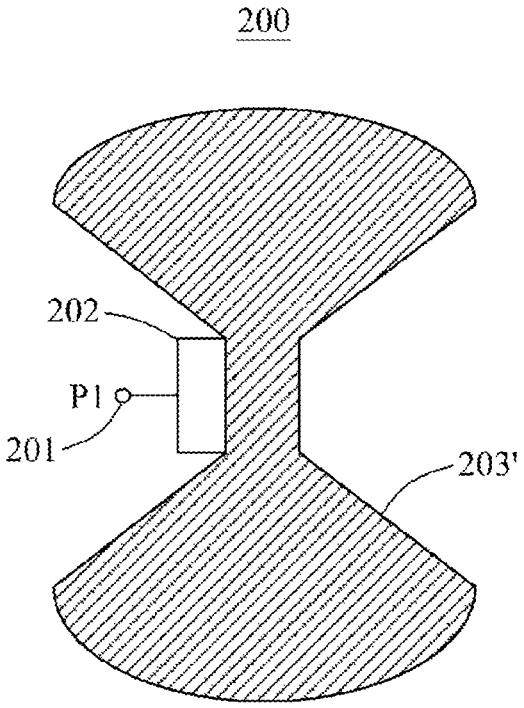
FIG. 7 illustrates a high-frequency high-power terminator according to further another embodiment.

FIG. 7 illustrates a high-frequency high-power terminator according to further another embodiment.

Referring to FIG. 7, a high-frequency high-power terminator 200 may include a signal input terminal 201, a transmission line 202, and a thin film resistor 203. Here, the thin film resistor 203' may be configured as a resistive element in a radial stub form having one side in contact with the transmission line, unlike the thin film resistors 203 illustrated in FIGS. 2, 5 and 6.

The thin film resistor 203 in the radial stub form may be an open branched line in contact with the transmission line 202 to be in series or parallel and may be configured in a form of two branched lines. The high-frequency high-power terminator 200 may perform impedance matching between the transmission line 202 and the thin film resistor 203' in the radial stub form.

Although not shown in FIG. 7, the transmission line 202 of FIG. 7 may be replaced with the transmission line 202' of FIG. 6 in the high-frequency high-power terminator 200.

Figure 8:
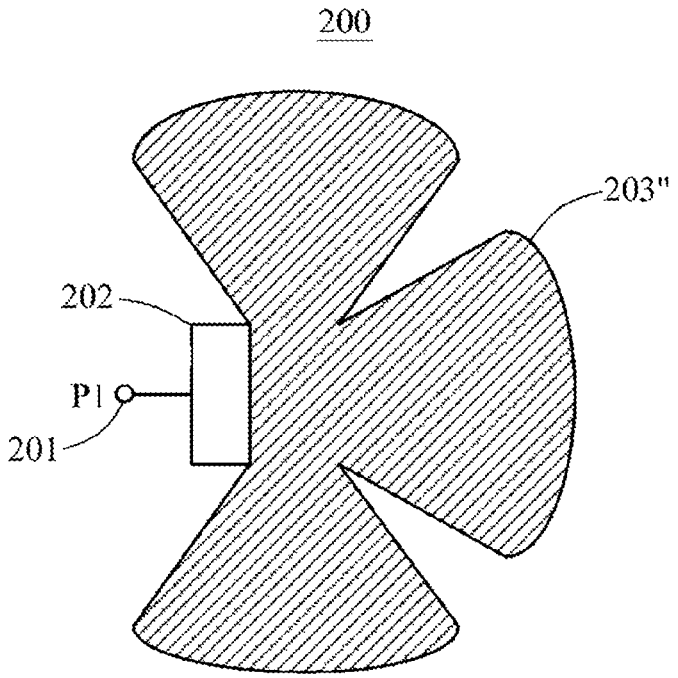
FIG. 8 illustrates a high-frequency high-power terminator according to further another embodiment.

FIG. 8 illustrates a high-frequency high-power terminator according to further another embodiment.

Referring to FIG. 8, a high-frequency high-power terminator 200 may include a signal input terminal 201, a transmission line 202, and a thin film resistor 203. Here, the thin film resistor 203" may be configured as a resistive element in a radial stub form having one side in contact with the transmission line, unlike the thin film resistors 203 illustrated in FIGS. 2, 5 and 6 and the thin film resistor 203' illustrated in FIG. 7.

The thin film resistor 203" in the radial stub form may be an open branched line in contact with the transmission line 202 to be in series or parallel and may be configured in a form of three branched lines. The high-frequency high-power terminator 200 may perform impedance matching between the transmission line 202 and the thin film resistor 203" in the radial stub form.

Although not shown in FIG. 8, the transmission line 202 of FIG. 8 may be replaced with the transmission line 202' of FIG. 6 in the high-frequency high-power terminator 200.

Figure 9:
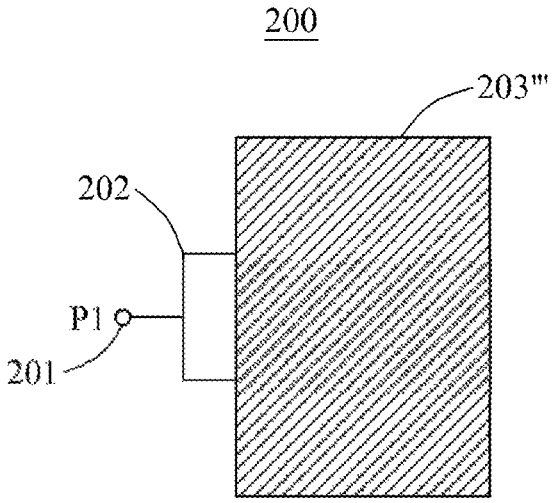
FIG. 9 illustrates a high-frequency high-power terminator according to further another embodiment.

FIG. 9 illustrates a high-frequency high-power terminator according to further another embodiment.

Referring to FIG. 9, a high-frequency high-power terminator 200 may include a signal input terminal 201, a transmission line 202, and a thin film resistor 203. Here, the thin film resistor 203'" may be configured as a resistive element in a polygonal form having one side in contact with the transmission line, unlike the thin film resistors 203 illustrated in FIGS. 2, 5 and 6, the thin film resistor 203 illustrated in FIG. 7, and the thin film resistor 203" illustrated in FIG. 8. The high-frequency high-power terminator 200 may perform impedance matching between the transmission line 202 and the thin film resistor 203'" in the polygonal form.

Although not shown in FIG. 9, the transmission line 202 of FIG. 9 may be replaced with the transmission line 202' of FIG. 6 in the high-frequency high-power terminator 200.

Figure 10:
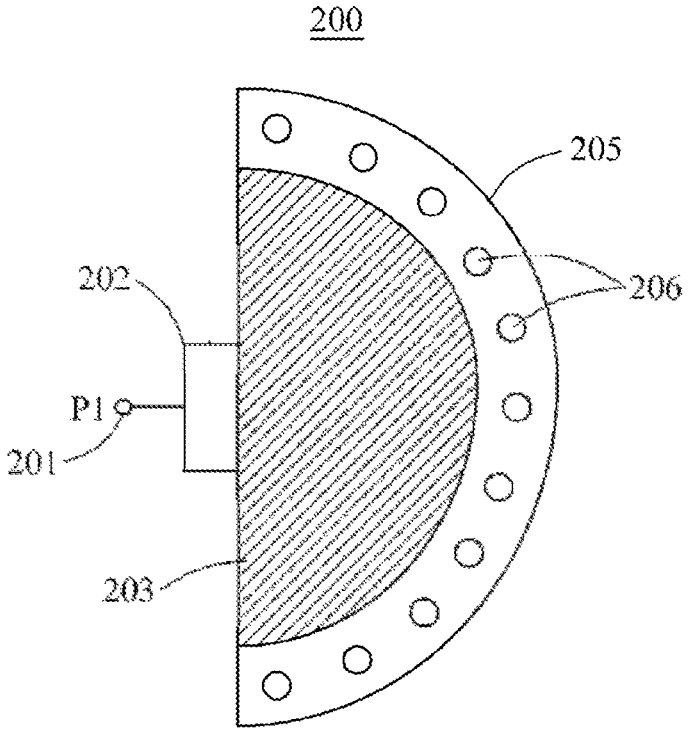
FIG. 10 illustrates a high-frequency high-power terminator according to further another embodiment.

FIG. 10 illustrates a high-frequency high-power terminator according to further another embodiment.

Referring to FIG. 10, a high-frequency high-power terminator 200 may include a signal input terminal 201, a transmission line 202, a thin film resistor 203, and a via hole pad 205. The via hole pad 205 may include a plurality of via holes 206.

Here, the via holes 206 may be included to form a direct current (DC) path between the thin film resistor 203 and a ground and to improve low-frequency characteristics occurring in the high-frequency high-power terminator 200. That is, referring to FIG. 3, the high-frequency high-power terminator 200 achieves matching in a wide band from about 1 to 180 GHz. Here, the high-frequency high-power terminator 200 does not achieve matching in a low frequency of 1 GHz or lower.

Thus, the high-frequency high-power terminator 200 may further include the via hole pad which is in contact with one side of the thin film resistor 203 and has the plurality of via holes connected to the ground in order to achieve matching in a low frequency of 1 GHz or lower.

Although not shown in FIG. 10, the transmission line 202 of FIG. 10 may be replaced with the transmission line 202' of FIG. 6 in the high-frequency high-power terminator 200.

Figure 11:
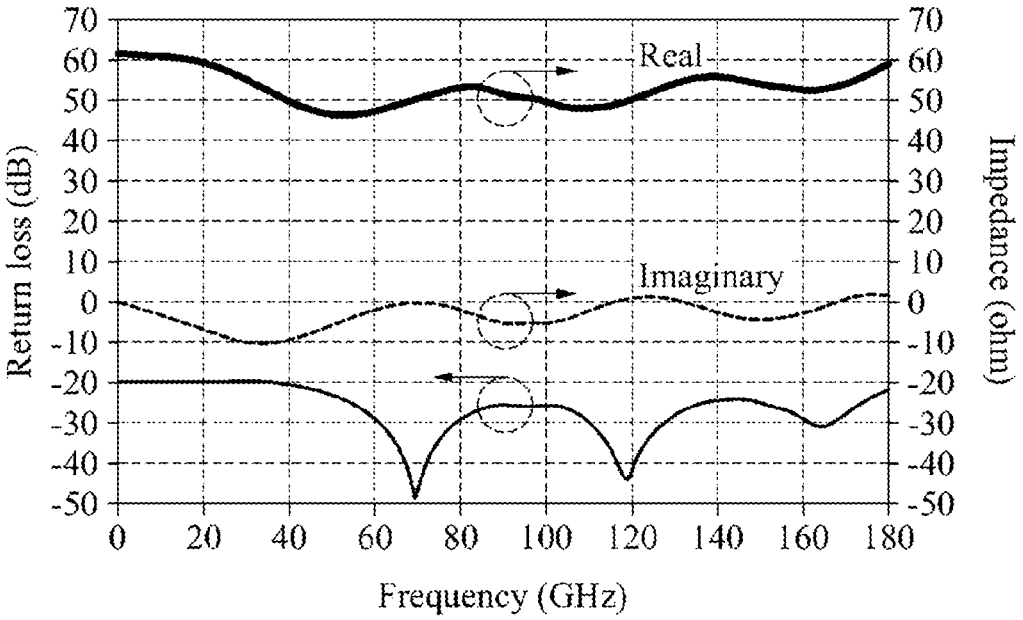
FIG. 11 is a graph illustrating return loss and frequency characteristics of impedance of the high-frequency high-power terminator of FIG. 10.

FIG. 11 is a graph illustrating return loss and impedance characteristics of the high-frequency high-power terminator of FIG. 10.

Referring to FIG. 11, the high-frequency high-power terminator 200 has a matched return loss of 20 dB or less in a wide band to 180 GHz in DC. That is, the high-frequency high-power terminator 200 has a matched return loss of 20 dB or less in a wide band from a low-frequency band to a high-frequency band, thus exhibiting improved low-frequency characteristics at 1 GHz or lower as compared with the high-frequency high-power terminator of FIG. 2.

The high-frequency high-power terminator 200 employs the thin film resistor 203 in a distributed element form, so that a real part and an imaginary part of impedance may not substantially change even with an increase in frequency. That is, the real part of the impedance may be in a range of about 45 to 60 Ohm, and the imaginary part of the impedance may be in a range of −10 to +3 Ohm. Such characteristics are similar to characteristics of an ideal high-frequency terminator.

Further, as a thinner substrate is used to design the high-frequency high-power terminator 200, a generated frequency in a parallel plate mode which limits a bandwidth may increase. Thus, the high-frequency high-power terminator 200 may increase a bandwidth thereof corresponding to an increase of the generated frequency in the parallel plate mode and thus is not limited to the bandwidth illustrated herein.

Ultimately, the high-frequency high-power terminator 200 may have high rated power even with a wide operating frequency range and high operating frequency by using a resistive element in a distributed element form. That is, the high-frequency high-power terminator 200 may be configured in a form which achieves broadband matching in an RF/microwave/millimeter-wave range and has increased rated power.

A high-frequency high-power terminator according to one embodiment may be used for transceivers of various wireless systems for personal mobile communications and satellite communications to terminate RF/microwave/millimeter-wave signals.

A high-frequency high-power terminator according to one embodiment may provide a high-frequency high-power terminator circuit with a new structure which achieves matching in a wide band of about 180 GHz and has rated power extended to hundreds of watts.

While the present invention has been described with reference to a few exemplary embodiments and the accompanying drawings, the present invention is not limited to the described exemplary embodiments. Instead, it would be appreciated by those skilled in the art that various modifications and variations can be made from the foregoing descriptions.

Therefore, it should be noted that the scope of the present invention is not limited by the illustrated embodiments but defined by the appended claims and their equivalents.

What is claimed is:

1. A high-frequency high-power terminator comprising:
- a signal input terminal to which a radio frequency (RF) signal is input;
- a transmission line through which the RF signal input from the signal input terminal is transferred; and
- a thin film resistor in a distributed element form configured to be in contact with the transmission line so that the RF signal is received by the thin film resistor,
- wherein the thin film resistor is a resistive element comprising:
  - a first side in linear contact with the transmission line, and
  - a semicircular second side in contact with the first side.

2. The high-frequency high-power terminator of claim 1, wherein the transmission line exhibits impedance specified in advance.

3. The high-frequency high-power terminator of claim 1, wherein the transmission line comprises a first side to which the RF signal is input and a second side in contact with the thin film resistor, and the second side has a wider width than the first side.

4. The high-frequency high-power terminator of claim 1, wherein the thin film resistor is a resistive element in a radial stub form comprising one side in contact with the transmission line.

5. The high-frequency high-power terminator of claim 1, further comprising an impedance matching circuit interposed between the signal input terminal and the transmission line.

6. The high-frequency high-power terminator of claim 5, wherein the impedance matching circuit is interposed to match the RF signal input from the signal input terminal with impedance of the transmission line.

7. A high-frequency high-power terminator comprising:
- a signal input terminal to which a radio frequency (RF) signal is input;
- a transmission line through which the RF signal input from the signal input terminal is transferred;
- a thin film resistor in a distributed element form configured to be in contact with one side of the transmission line so that the RF signal is received by the thin film resistor; and
- a via hole pad including a plurality of via holes connected to a ground and contacting a semicircular second side of the thin film resistor,
- wherein the thin film resistor is a resistive element comprising:
  - a first side in linear contact with the transmission line, and
  - the semicircular second side in contact with the first side.

* * * * *